US006897606B2

(12) United States Patent
Deguchi

(10) Patent No.: US 6,897,606 B2
(45) Date of Patent: May 24, 2005

(54) FLUORESCENT-SUBSTANCE LIGHT EMITTING ELEMENT AND METHOD OF FABRICATION THEREOF, AND IMAGE RENDERING DEVICE

(75) Inventor: Masahiro Deguchi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 44 days.

(21) Appl. No.: 10/751,813

(22) Filed: Jan. 6, 2004

(65) Prior Publication Data

US 2004/0135492 A1 Jul. 15, 2004

Related U.S. Application Data

(63) Continuation of application No. PCT/JP03/08351, filed on Jul. 1, 2003.

(30) Foreign Application Priority Data

Jul. 1, 2002 (JP) ..... 2002-191893

(51) Int. Cl.[7] ..... H01J 31/12
(52) U.S. Cl. ..... 313/496; 313/497; 445/24
(58) Field of Search ..... 313/311, 422, 313/495–497; 345/74.1–74.3; 445/24

(56) References Cited

U.S. PATENT DOCUMENTS 5,202,571 A 4/1993 Hirabayashi et al.
6,603,257 B1 * 8/2003 Hasan et al. ..... 313/496
2004/0085011 A1 * 5/2004 Koshida ..... 313/311

FOREIGN PATENT DOCUMENTS

| | | | | |
|---|---|---|---|---|
| EP | 1 278 227 A1 | | 1/2003 | |
| JP | 7-21996 | | 3/1995 | |
| JP | 8-250766 | | 9/1996 | |
| JP | 9-90882 | | 4/1997 | |
| JP | 2728228 | | 12/1997 | |
| JP | 10-269970 | | 10/1998 | |
| JP | 10269970 A | * | 10/1998 | ..... H01J/29/87 |
| JP | P2000-285797 A | | 10/2000 | |
| JP | P2000-306493 A | | 11/2000 | |
| WO | WO 01/71759 A1 | * | 9/2001 | ..... H01J/1/312 |

* cited by examiner

*Primary Examiner*—Vip Patel
*Assistant Examiner*—Glenn Zimmerman
(74) *Attorney, Agent, or Firm*—McDermott Will & Emery LLP

(57) ABSTRACT

The present invention discloses a fluorescent-substance light emitting element comprising a cold cathode type emitter section for emitting electrons, a fluorescent-substance layer configured to emit light by collision with electrons emitted from the emitter section, and an anode section disposed to be opposed to the emitter section and having an anode electrode and the fluorescent-substance layer provided inside of the anode electrode, wherein a porous-substance layer, comprising an electrically insulative porous substance which is a solid substance having a solid skeletal part formed into a three-dimensional network shape and a hole extending continuously in the form of a mesh of the solid skeletal part, is sandwiched between the emitter section and the anode section.

22 Claims, 9 Drawing Sheets

FLUORESCENT-SUBSTANCE LIGHT EMITTING ELEMENT AND METHOD OF FABRICATION THEREOF, AND IMAGE RENDERING DEVICE

This is a continuation application under 35 U.S.C 111(a) of pending prior International application No.PCT/JP03/08351, filed on Jul. 1, 2003.

BACKGROUND OF THE INVENTION

1. Field of the Invention

The present invention relates to a fluorescent-substance light emitting element which is provided with a porous-substance layer having a gas phase/solid phase mixed structure, more particularly, a fluorescent-substance light emitting element which is provided with a porous-substance layer having a porous structure formed by microparticles of an insulating material and to a method of fabrication thereof, and to an image rendering device making utilization of such a fluorescent-substance light emitting element.

2. Description of the Related Art

The CRT (Cathode Ray Tube) has been the typical element (device) for causing a fluorescent substance to emit light by making use of a phenomenon of electron emission from a solid substance. However, thin-type field emission displays (FEDs) employing, as an emitter, a cold cathode type micro-electron emitting element have attracted attention in recent years. Such a cold cathode type emitter draws electrons from the surface of a solid substance into vacuum by a tunnel effect or the like with no heating. For example, Spindt type, MIM (Metal-Insulator-Metal) type, BSD (Ballistic electron Surface-emitting Display) type, and other type have been known in the art.

Firstly, Spindt type electron emitting elements are disclosed in U.S. Pat. No. 3,665,241 and other patents. The action of such a Spindt type electron emitting element is that electrons are emitted in vacuum by impressing a high electric field ($>1\times10^9$ V/m) on the point of a minute conical emitter section composed of a high melting point metallic material such as Silicon (Si), molybdenum (Mo), and the like.

Secondary, MIM type cold cathode emitters have a structure (metal-insulator-metal) formed by sandwiching an extremely thin insulator layer between a pair of metallic electrode layers. Hereby, electrons tunneling through the intermediate insulator layer are emitted into vacuum by impression of a voltage between the metallic electrodes.

Finally, BSD type cold cathode emitters, as set forth in Japanese Patent Kokai Publication No. (1996)250766, have basically the same principle as the MIM type, with the exception that the layer, through which electrons tunnel, is formed of porous polysilicon. Electrons are emitted through such a microcrystal silicon layer, thereby enhancing the energy of excitation of injected electrons. Therefore, the BSD type cold cathode emitter is characterized in that it is superior in the parallelism of emitted electrons.

Of various fluorescent-substance light emitting elements making utilization of the above-described cold cathode emitters, a fluorescent-substance light emitting element employing a Spindt type cold cathode emitter (hereinafter referred to as "the first prior art example") is shown in FIG. 8. On the other hand, a fluorescent-substance light emitting element making utilization of an MIM (or BSD) type cold cathode emitter (hereinafter referred to as "the second prior art example") is shown in FIG. 9.

In FIGS. 8 and 9, fluorescent-substance light emitting elements (71, 81) each constitute a single pixel in a screen of an image rendering device. Usually, such a screen is made up of a great number of pixels. Accordingly, FIGS. 8 and 9 typically illustrate configurations of the fluorescent-substance light emitting elements (71, 81) for a single pixel.

Referring to FIG. 8, in the first prior art example, a cold cathode emitter section 72 is formed on an inner surface (upper surface) of a plate-like rear substrate 51 and an anode section 53 comprising an anode electrode 57 and a fluorescent-substance layer 56 is formed on an inner surface (lower surface) of a front substrate 58. The rear substrate 51 and the front substrate 58 are opposed to each other. In addition, a spacer 61 is disposed between the edge of the rear substrate 51 and the edge of the front substrate 58 over the circumference, and the space between the spacer 61 and the edge of the rear substrate 51 and the space between the spacer 61 and the edge of the front substrate 58 are sealed off with paste or the like.

As a result of such configuration, an airtight space 62 is defined between the rear substrate 51 and the front substrate 58, and the airtight space 62 is maintained substantially in a vacuum state. The Spindt type emitter section 72 has a lower electrode 52, an insulator layer 63, a conical structural member 53 formed of Si or Mo, and a gate electrode 54. Furthermore, a voltage (59) is applied between the gate electrode 54 and the anode electrode 57, and a voltage (60) is applied between the lower electrode 52 and the gate electrode 54.

In the first prior art example thus constructed, electrons (hereinafter referred to as "the emitted electrons") emitted from the conical structural member 53 of the cold cathode emitter section 72 into the airtight space 62 are accelerated by a voltage applied between the gate electrode 54 and the anode electrode 57, and collide with the fluorescent-substance layer 56. As a result, the fluorescent-substance layer 56 emits light.

Further, as shown in FIG. 9, in the second prior art example, an MIM or BSD type emitter section 82 is formed on an inner surface of the rear substrate 51 in place of the Spindt type emitter section 72 of the first prior art example. In the case where the emitter section 82 is of the MIM type, the emitter section 82 is provided with a lower metallic electrode 52, an insulator layer 53, and an upper metallic electrode 54. In the case where the emitter section 82 is of the BSD type, the emitter section 82 is provided with a lower electrode 52, a porous polysilicon layer 53, and an upper electrode 54. And, the voltage (59) is applied between the upper metallic electrode or upper electrode 54 and the anode electrode 57 and, on the other hand, the voltage (60) is applied between the lower metallic electrode or lower electrode 52 and the upper metallic electrode or upper electrode. Other configurations are the same as the first prior art example.

Incidentally, in each of the conventional fluorescent-substance light emitting elements (the first and second prior art examples) making use of a cold cathode emitter, it is arranged such that electrons are emitted into the airtight space 62. Accordingly, it is required that the airtight space 62 is made extremely narrow (approximately about 0.1 mm to about 1 mm) by the use of the spacer 61 in order to maintain stable fluorescent-substance light emitting characteristics. In addition, the airtight space 62 is required to be maintained in a high vacuum state.

Consequently, the prior art fluorescent-substance light emitting elements suffer the following problems.

A first problem is that it is essential to form the airtight space 62 which must be extremely narrow, and it is difficult to prepare the airtight space 62 in a large area with high accuracy.

A second problem is as follows. It is necessary to maintain the interior space of a housing (comprised of the spacer 61, the rear substrate 51, and the front substrate 58) which forms the airtight space 62 in a high vacuum state. Therefore, it is required for the housing to have a structure capable of withstanding pressure. Because of this, it is required that the material of the housing be thickened.

In addition to the foregoing first and second prior art examples, Japanese Patent Kokai Publication No. (2000) 285797 and JP Pat. No. 3112456 disclose techniques relevant to the present invention.

SUMMARY OF THE INVENTION

Bearing in mind the above-described problems in the prior art, the present invention was made. Accordingly, a first object of the present invention is to provide a fluorescent-substance light emitting element which does not require the provision of a housing for strength maintenance, and an image rendering device employing such a fluorescent-substance light emitting element.

Additionally, a second object of the present invention is to provide a fluorescent-substance light emitting element capable of managing with a housing of low airtightness, and an image rendering device employing such a fluorescent-substance light emitting element.

In order to achieve these objects, the present invention provides a fluorescent-substance light emitting element comprising a cold cathode type emitter section for emitting electrons, a fluorescent-substance layer configured to emit light by collision with electrons emitted from the emitter section, and an anode section disposed to be opposed to the emitter section and having an anode electrode and the fluorescent-substance layer provided inside of the anode electrode, wherein a porous-substance layer, composed of an electrically insulative porous substance, is sandwiched between the emitter section and the anode section.

As a result of such configuration, the porous layer interposed between the emitter section and the anode section allows electrons emitted from the emitter section to pass through holes of the porous layer, and functions as a solid substance, thereby making it possible to eliminate the need for the provision of a housing for strength maintenance while holding the function of enabling the fluorescent-substance layer to emit light.

The porous substance may comprise a solid substance which has a solid skeletal part formed into a three-dimensional network shape and a hole extending continuously in the form of a mesh of the solid skeletal part.

As a result of such configuration, the continuous holes of the porous substance function as passageways of emitted electrons, and the solid skeletal part of the porous substance functions as a solid substance, thereby making it possible to realize a more suitable porous-substance layer.

The porous-substance layer may be in contact with the emitter section.

The porous-substance layer may be in contact with the anode section.

The porous-substance layer may be in contact with both the emitter section and the anode section.

It is preferable that the volume ratio of the solid skeletal part in the porous-substance layer is more than 0% and not more than 15%. This configuration makes it possible to reduce the energy loss of emitted electrons while holding the function of the porous-substance layer serving as a solid substance.

It is preferable that the volume ratio of the solid skeletal part in the porous-substance layer is not less than 3% and not more than 15%. This configuration makes it possible to reduce the energy loss of emitted electrons to a further extent.

It is preferable that the solid skeletal part of the porous-substance layer is composed of a plurality of particles connected together and the size of the particles is not less than 3 nm and not more than 20 nm. This configuration makes it possible to reduce the energy loss of emitted electrons while holding the function of the porous-substance layer serving as a solid substance.

It is preferable that the particle size is not less than 3 nm and not more than 10 nm. This configuration makes it possible to reduce the energy loss of emitted electrons to a further extent.

It is preferable that gas pressure of a region between the emitter section and the anode section is not less than $1.33\times10^{-3}$ Pa and not more than $1.01\times10^{5}$ Pa. This configuration allows the use of a housing of low airtightness.

It is more preferable that the gas pressure of the region between the emitter section and the anode section is not less than $1.33\times10^{-2}$ Pa and not more than $1.33\times10^{-1}$ Pa.

The porous-substance layer may be composed of one of $SiO_2$, $Al_2O_3$, and MgO. This configuration makes it possible to appropriately form an electrically insulative porous-substance layer.

The fluorescent-substance layer may be formed by a porous fluorescent-substance layer in which a fluorescent substance is scattered in the hole portion of the porous substance. This configuration achieves an increase in effective area of the fluorescent substance, thereby providing improvements in light-emission luminance.

The porous fluorescent-substance layer may comprise a first porous fluorescent-substance layer and a second porous fluorescent-substance layer, wherein the first porous fluorescent-substance layer may is formed in contact with the anode electrode and the second porous fluorescent-substance layer is formed in the porous-substance layer.

In accordance with such configuration, the fluorescent-substance layer is provided also in the porous-substance layer, thereby achieving an increase (corresponding to such provision) in effective area of the fluorescent substance. As a result, the luminance of light emission is improved to a further extent.

The emitter section may has an electron supplying layer for supplying electrons, an electron transporting layer in which electrons supplied from the electron supplying layer are movable, and a control electrode layer for emission of electrons moving in the electron transporting layer from the emitter section by a voltage applied between the control electrode layer and the electron supplying layer.

A surface of the electron transporting layer close to the side of the control electrode layer may has either a negative electron affinity or an electron affinity close to zero. As a result of such configuration, electrons supplied from the electron supplying layer are emitted readily from the surface of the control electrode layer to the porous-substance layer, thereby reducing the variation in energy of the emitted electrons.

The emitter section may be formed by a cold cathode type emitter of one of MIM, BSD, and Spindt type.

Additionally, the present invention provides a method of fabricating a fluorescent-substance light emitting element having a cold cathode type emitter section for emitting electrons, a fluorescent-substance layer configured to emit light by collision with electrons emitted from the emitter section, and an anode section disposed to be opposed to the emitter section and having an anode electrode and the fluorescent-substance layer provided inside of the anode electrode, the method comprising the step of providing, between the emitter section and the anode section, a porous-substance layer comprising an electrically insulative porous substance which is a solid substance having a solid skeletal part formed into a three-dimensional network shape and a hole extending continuously in the form of a mesh of the solid skeletal part.

The porous-substance layer may be formed by means of a sol-gel transition reaction. This configuration makes it possible to form a porous-substance layer in a large area with ease and with high uniformity. As a result, it is possible to reduce the fabrication costs of fluorescent-substance light emitting elements and, further, it is possible to improve their quality to higher levels.

In formation of the porous-substance layer, a wet gel structure may be dried by a supercritical dry technique. This configuration makes it possible to easily form a microfine porous-substance layer with a great number of hole portions without deformation and destruction of the porous-substance layer which may occur during drying process.

The present invention provides an image rendering device comprising a fluorescent-substance light emitting element according to claim 1. This configuration makes it possible to realize an image rendering device which does not require the provision of a housing for the maintenance of strength.

These objects as well as other objects, features and advantages of the present invention will become apparent to those skilled in the art from the following description with reference to the accompanying drawings.

DETAILED DESCRIPTION OF THE PREFERRED EMBODIMENT

Hereinafter, embodiments of the present invention will be described with reference to the accompanying drawings.

First Embodiment

Figure 1:
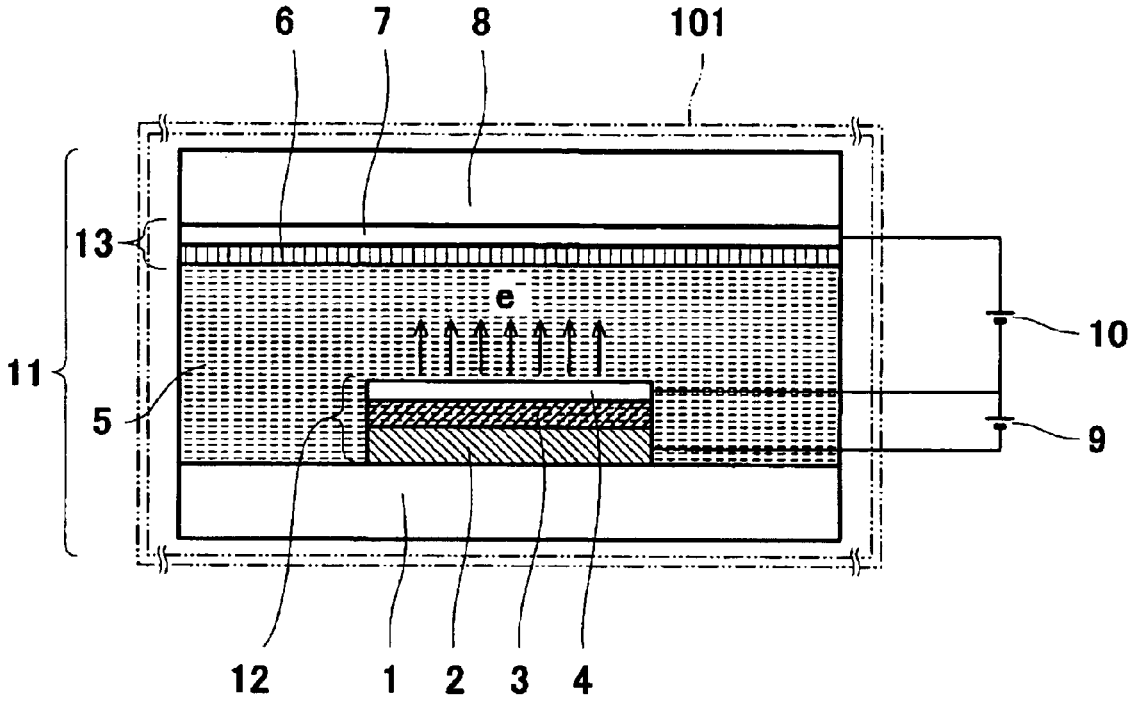
FIG. 1 is a cross sectional view typically showing a configuration of a fluorescent-substance light emitting element according to a first embodiment of the present invention.

FIG. 1 is a cross sectional view typically showing a configuration of a fluorescent-substance light emitting element according to a first embodiment of the present invention.

Referring to FIG. 1, the fluorescent-substance light emitting element 11 of the present embodiment has a plate-like rear substrate 1 and a plate-like front substrate 8. A cold cathode type emitter section 12 is formed in a predetermined area of an inner surface (upper surface) of the rear substrate 1.

Generally, the fluorescent-substance light emitting element 11 constitutes a single pixel in a screen of an image rendering device. Usually, such a screen is made up of a great number of pixels, and FIG. 1 depicts a configuration of the fluorescent-substance light emitting element 11 for a single pixel. Of course, a single fluorescent-substance light emitting element may be used for display et cetera.

Formed in sequence on an inner surface (lower surface) of the front substrate 8 are an anode electrode 7 and a fluorescent-substance layer 6. The anode electrode 7 and the fluorescent-substance layer 6 together constitute an anode section 13. The anode electrode 7 may be provided for every arbitrary number of pixels, or the anode electrode 7 common to all the pixels may be provided.

The rear substrate 1 and the front substrate 8 are disposed apart from each other at a predetermined interval (approximately, not less than about 0.1 mm and not more than about 1 mm) so that their inner surfaces are opposed to each other. Interposed between the inner surface of the rear substrate 1 and the inner surface of the front substrate 8 is a porous-substance layer 5.

The emitter section 12 is a part having a function of emitting electrons to the porous-substance layer 5, and comprises an electron supplying layer 2, an electron transporting layer 3, and a control electrode layer 4 which are formed in sequence on the rear substrate 1. The electron supplying layer 2 supplies electrons. The electron transporting layer 3 transports the supplied electrons to the emission surface. The control electrode layer 4 applies voltages for electron transportation and electron emission and emits the electrons to the porous-substance layer 5. Accordingly the structure of the emitter section 12 is not limited to a particular one, in other words the emitter section 12 may have any structure as long as the emitter section 12 is comprised of these layers having the foregoing functions respectively and is able to emit electrons efficiently to the porous-substance layer 5. More specifically, the emitter section 12 may be a cold cathode type emitter of the Spindt, MIM, BSD, or other type. The emitter section 12, shown in FIG. 1, is a cold cathode type emitter of the MIM or BSD type.

In the case where the emitter section 12 is formed by a cold cathode type emitter of the MIM type (hereinafter referred to just as "the MIM type"), the electron supplying layer 2, the electron transporting layer 3, and the control electrode layer 4 are formed by a lower metallic electrode of the MIM type, an insulator layer of the MIM type, and an upper metallic electrode of the MIM type, respectively. As the material of the insulator layer, for example, $SiO_2$, $Al_2O_3$, or other material is used.

On the other hand, in the case where the emitter section 12 is formed by a cold cathode type emitter of the BSD type (hereinafter referred to just as "the BSD type"), the electron supplying layer 2, the electron transporting layer 3, and the control electrode layer 4 are formed by a lower metallic electrode of the BSD type, a porous polysilicon layer of the BSD type, and an upper electrode of the BSD type, respectively.

The anode section 13 is a part having a function of applying a voltage for accelerating electrons within the porous-substance layer 5 and a function of causing a fluorescent substance to emit light, and has, as described above, the anode electrode 7 and the fluorescent-substance layer 6. The anode electrode 7 applies an acceleration voltage (hereinafter referred to as "the anode voltage") on electrons emitted into the porous-substance layer 5, and the fluorescent-substance layer 6 emits light when struck by the electrons.

In accordance with the present embodiment, it is constructed such that light emitted by the fluorescent-substance layer 6 is drawn out from the side of the front substrate 8. Therefore, the anode electrode 7 is generally formed by a transparent conductive layer of ITO or the like, and the front substrate 8 is formed by a transparent glass substrate or the like.

As the material used to form the fluorescent-substance layer 6, a fluorescent-substance material, selected from among ZnO:Zn, ZnS-based fluorescent substance et cetera in conjunction with a desired light-emission color, is employed. However, at the time of making such a selection, it is important to select a fluorescent-substance material which is most efficient when considering into account the value of energy held by emitted electrons, i.e., the value of the anode voltage.

A voltage for electron emission is applied between the electron supplying layer 2 and the control electrode layer 4 by a control power supply 9. On the other hand, an anode voltage is applied between the control electrode layer 4 and the anode electrode 7 by an acceleration power supply 10.

Next, the porous-substance layer 5 which characterizes the present invention will be described in detail.

Figure 2:
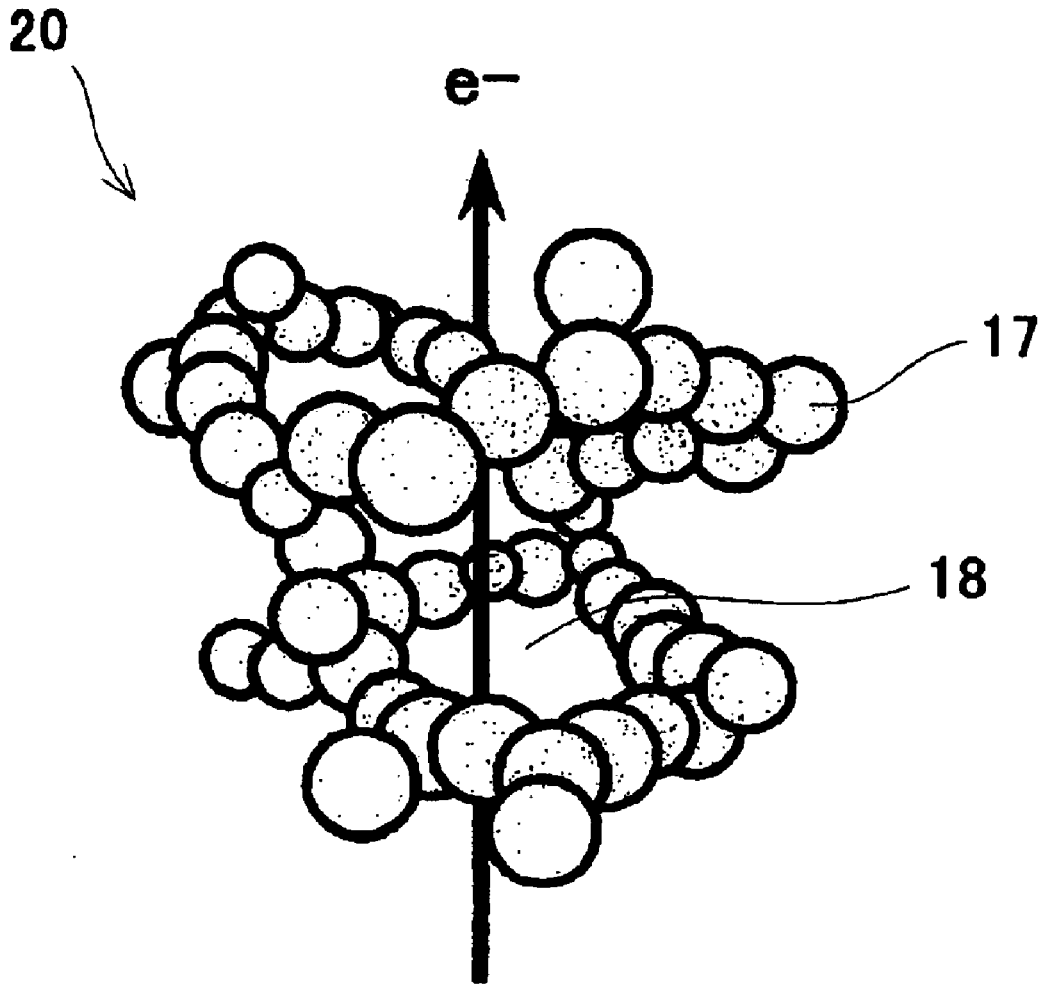
FIG. 2 is a view typically enlargedly showing a microstructure of a porous substance which is used to form a porous-substance layer of FIG. 1.

FIG. 2 is a diagram typically enlargedly showing a microstructure of a porous substance 20 used to form the porous-substance layer 5 of FIG. 1.

Referring to FIG. 2, the porous substance 20 employed in the present invention (hereinafter referred to just as "the porous substance") is a solid substance which has a solid skeletal part 17 formed into a three-dimensional network shape and a hole 18 extending continuously in the form of a mesh of the solid skeletal part 17 (hereinafter referred to as "the continuous hole"). The porous substance 20 can be prepared by means of molding of fine particles of a substrate, baking of fine particles, chemical blowing, physical blowing, sol-gel technique, or other technique. In the fluorescent-substance light emitting element 11 of the present invention, a porous substance that has a large number of holes 18 of nanometer size provides preferable effects.

As described above, the porous substance 20 has the solid skeletal part 17 and the continuous holes 18. It is preferable that the solid skeletal part 17 is formed by connecting together a plurality of particles whose particle size (diameter) is not less than 3 nm and not more than 20 nm so that they are formed into a three-dimensional network. Each continuous hole 18 is formed as a void in the form of a mesh of the solid skeletal part 17 and its size (diameter) is preferably not less than 10 nm and not more than 100 nm. The porous substance 20 maintains its shape as a solid substance by the solid skeletal part 17, and contains a great number of continuous holes 18. This makes it possible to have electrons, emitted into the porous-substance layer 5, act as if they are propagating in the space by a voltage applied on the anode electrode.

As is obvious, part of the emitted electrons are scattered by the solid skeletal part 17 of the porous substance 20, and lose energy; however, since the size (diameter) of the solid skeletal part 17 is on the order of several nanometers, this makes it possible to irradiate the fluorescent-substance layer 6 with most of the emitted electrons. In other words, the fluorescent-substance layer 6 is able to emit light.

Figure 8:
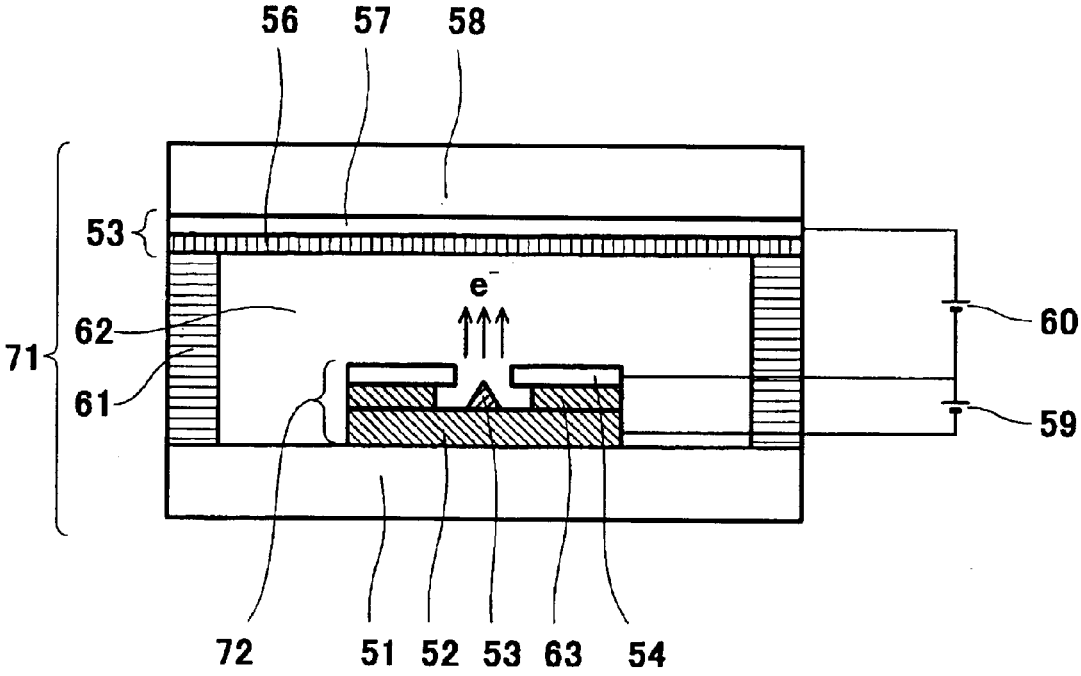
Fig. 8 PRIOR ART
FIG. 8 is a cross sectional view typically showing a configuration of a conventional fluorescent-substance light emitting element employing a cold cathode emitter of the Spindt type.

On the other hand, since the porous substance 20 maintains its shape as a solid substance by the solid skeletal part 17, the clearance between the rear substrate 1 and the front substrate 8 is maintained by the porous-substance layer 5. Like the prior art examples, the space sandwiched between the emitter section 12 and the anode section 13 is depressurized. Therefore, also in the present invention, the continuous hole 18 of the porous substance 20 constituting the porous-substance layer 5 sandwiched between the emitter section 12 and the anode section 13 is depressurized (details of such depressurization in the present invention will be discussed later), and an external pressure (in many cases, the atmospheric pressure) is exerted on the rear and front substrates 1 and 8. However, unlike the prior art examples, the solid skeletal part 17 of the porous substance 20 constituting the porous-substance layer 5 copes with such an external pressure. Consequently, in the present embodiment, the spacer 61 of FIG. 8 which requires microfabrication is not necessarily provided. Additionally, although the spacer 61, shown in FIG. 8, is required to be provided for every pixel, the porous substance 20 is formed just by coating of a solution which becomes the porous substance 20 all over the rear substrate 1 as will be described later, thereby making the fabrication easy to perform in comparison with the prior art examples. Furthermore, the preparation of a high airtight housing which is difficult to construct is no longer required.

Figure 9:
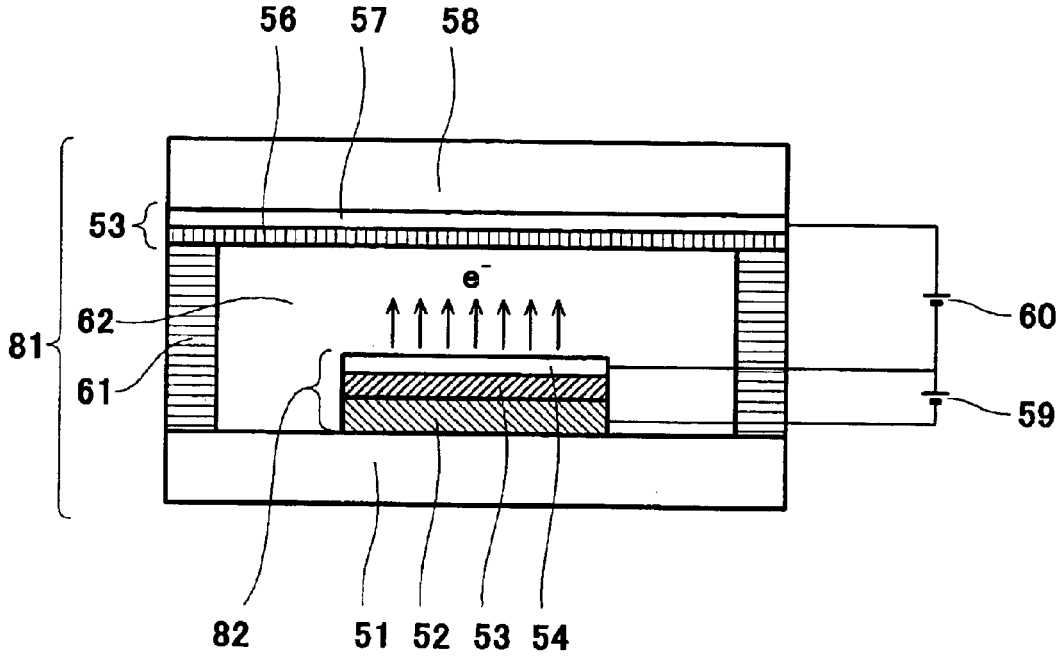
Fig. 9 PRIOR ART
FIG. 9 is a cross sectional view typically showing a configuration of a conventional fluorescent-substance light emitting element employing a cold cathode emitter of the MIM or BSD type.

However, in the case where the strength of the fluorescent-substance light emitting element 11 is insufficient, a housing for reinforcement may be provided. In addition, as will be described later, in the case where the space between the emitter section 12 and the anode section 13 is required to be airtight, a housing may be provided for the purpose of maintaining airtightness. Such a housing for reinforcement and airtightness maintenance is constructed by disposing the spacer 61 between the edge of the rear substrate 1 and the edge of the front substrate 8 over the circumference, and both the space between the spacer 61 and the edge of the rear substrate 1 and the space between the spacer 61 and the edge of the front substrate 8 are sealed off with paste or the like, as in the prior art examples of FIGS. 8 and 9. Furthermore, as shown in FIG. 1, the housing may be implemented by a housing 101 which houses and seals the entire fluorescent-substance light emitting element 11.

As the porous substance 20, especially a dry gel prepared by a sol-gel technique may be cited as a strong candidate.

Here, the dry gel is the porous substance 20 which has the solid skeletal part 17 constituted by particles whose size is not less than 3 nm and not more than 20 nm, and which is provided with the continuous holes whose average hole diameter is not less than 10 nm and not more than 100 nm. Further, as the material of the porous substance 20, in the view of the fact that an accelerated voltage is applied thereon, materials which exhibit relatively high resistance electric characteristics are suitable. In particular, porous silica (silicon dioxide: $SiO_2$), porous alumina (aluminum oxide: $Al_2O_3$), porous magnesium oxide (MgO) et cetera are suitable.

A method of obtaining porous silica composed of a dry gel employed in the present invention is roughly divided into two steps, namely a step of obtaining a wet gel and a step of drying it.

In the first place, a wet gel is synthesized by having a material of silica, mixed in a solvent, undergo a sol-gel reaction. At this time, a catalyst may be used if necessary. In this synthetic process, the source material forms microparticles while reacting in the solvent, and the microparticles becomes networked to form a mesh-like skeletal part. More specifically, the compositions of the source material which is a solid component and the solvent are determined so that porous silica of a predetermined porosity is obtained. A catalyst, a viscosity adjuster, and so on are added to a solution prepared according to the determined compositions, and the solution is agitated and is set into a desired form for use, by casting/application or the like. In this state, the solution is let stand for a certain period of time so that the solution becomes a gel. Hereby, a silica wet gel is obtained. The temperature as a fabrication condition is in the vicinity of room temperature which is a normal working temperature. However, the solution may be heated up to a temperature below the boiling point of the solvent as required.

As the material of silica, alkoxysilane compounds (e.g., tetramethoxysilane, tetraethoxysilane, trimethoxymethylsilane, and dimethoxydimethylsilane), their oligomer compounds, sodium silicate (silicate of soda), water glass compounds such as potassium silicate, and colloidal silica et cetera may be used alone or in mixed manner.

As a solvent, since it suffices if the material is dissolved to form silica, water and commonly-used organic solvents (e.g., methanol, ethanol, propanol, acetone, toluene, and hexane) may be used alone or in mixed manner.

As a catalyst, water, various acids (e.g., hydrochloric acid, sulphuric acid, and acetic acid), and bases of ammonia, pyridine, sodium hydroxide, potassium hydroxide et cetera may be used.

As a viscosity adjuster, ethylene glycol, glycerin, polyvinyl alcohol, silicon oil et cetera may be used: however, the viscosity adjuster is not limited to these as long as the wet gel is set into predetermined desired form for use.

Next, a drying step of obtaining a dry gel from a wet gel will be described below.

As a dry technique, normal dry techniques (e.g., natural drying, baking, and drying under reduced pressure), supercritical dry techniques, freeze dry techniques et cetera may be used. However, in general, normal dry techniques are not suitable because the porous substance 20 shrinks by stress during solvent evaporation. Therefore, as a method of forming a dry gel, it is preferable for the present invention to employ a supercritical dry technique. Furthermore, by subjecting a solid component surface of the wet gel to a water-repellent treatment or the like, the occurrence of gel shrinkage during drying process can be prevented.

As a solvent for use in such a supercritical dry technique, the solvent of the wet gel can be used. Furthermore, prereplacement by a solvent which is easy to deal with in the supercritical dry technique is preferable where necessary.

As a replacement solvent, alcohol used as a supercritical fluid (e.g., methanol, ethanol, and isopropyl alcohol), carbon dioxide, water et cetera may used. Additionally, the solvent may be replaced by an organic solvent which is eluted readily into the foregoing supercritical fluids and is generally easy to deal with (e.g., acetone, isoamyl acetate, and hexane) may be used.

The supercritical dry conditions are as follows. Drying is carried out in a pressure vessel such as an autoclave. For example, for the case of methanol, in its critical pressure and temperature conditions (pressure: 8.09 MPa; and temperature: not less than 239.4 degrees Centigrade), drying is performed by gradually releasing pressure in a temperature-constant state. In addition, for the case of carbon dioxide, in its critical pressure and temperature conditions (pressure: 7.38 MPa; and temperature: not less than 31.1 degrees Centigrade), drying is performed by gradually releasing pressure at such critical conditions in a temperature-constant state. For the case of water, drying is carried out in its critical pressure and temperature conditions (pressure: 22.04 MPa; and temperature: not less than 474.2 degrees Centigrade), drying is performed. For the drying process, there should be taken a certain elapse of time more than the time during which the solvent in the wet gel is replaced more than once by a supercritical fluid.

For the case of a technique in which a wet gel is dried and thereafter subjected to a water-repellent treatment, a surface finishing agent for the water-repellent treatment is made to react with a solid component surface of the wet gel. This reduces surface tension occurring in a hole of the mesh structure of the wet gel, thereby making it possible to suppress shrinkage occurring during normal drying.

As a surface finishing agent, a halogen-based silane surface finishing agents (e.g., trimethylchlorosilane and dimethylchlorosilane), alkoxy-based silane surface finishing agents (e.g., trimethylmethoxysilane and trimethylethoxysilane), silicon-based silane surface finishing agents (e.g., hexamethyldisiloxane and dimethylsiloxane oligomer), amine-based silane surface finishing agents (e.g., hexamethyldisilazane), and alcohol-based surface finishing agents (e.g., propyl alcohol and butyl alcohol) may be used. In addition to these surface finishing agents, any other agent may be used as long as it provides the same effect.

As the material of the wet gel obtained in the present method, in addition to silica, other inorganic and organic polymer materials may be used. As the component of the solid skeletal part formed of a dry gel of an inorganic oxide, commonly-used ceramics obtained by a sol-gel reaction, such as silica (silicon dioxide), alumina (aluminum oxide), and magnesium oxide, may be used.

Furthermore, as the porous substance 20, other than the above-mentioned dry gel, for example, a sintered body, obtained by sintering of fine particles of ceramics of silica, alumina, or magnesium oxide, may be used.

Next, the operation of the fluorescent-substance light emitting element 11 as constructed above will be described.

Referring to FIGS. 1 and 2, when a voltage for electron emission is applied between the electron supplying layer 2 and the control electrode layer 4 by the control power supply 9 while an anode voltage is applied between the electron supplying layer 2 and the control electrode layer 4 by the acceleration power supply 10, the electron supplying layer 2 supplies the electron transporting layer 3 with electrons. These supplied electrons pass through the electron transporting layer 3, and are emitted from the control electrode layer 4 to the porous-substance layer 5. While passing through the continuous holes 18 of the porous-substance layer 5, the emitted electrons are accelerated by the anode voltage, and collide with the fluorescent-substance layer 6. This causes the fluorescent-substance layer 6 to emit light, and the emitted light is emitted to the outside from the front substrate 8.

Next, concrete examples of the fluorescent-substance light emitting element 11 of the present embodiment will be described.

First Example

In the first example, a production example of the fluorescent-substance light emitting element 11 of FIG. 1 is shown.

Referring to FIG. 1, a production procedure of the emitter section 12 is illustrated. In the first place, a metallic lower electrode as the electron supplying layer 2 and a polycrystalline polysilicon layer, made porous by anodic oxidation, as the electron transporting layer 3 were formed, in this order, on a principal surface of the rear substrate 1 composed of a glass plate. Then, an upper electrode of gold as the control electrode layer 4 was formed on the electron transporting layer 3. Hereby, the emitter section 12 similar to a so-called BSD type was formed.

In the present example, the rear substrate 1 is composed of glass. However, other insulative substrates (such as a ceramic substrate) may be used. The provision of the electron supplying layer 2 may be omitted when employing an electrically conductive substrate such as a low-resistance silicon substrate and a metallic substrate. Further, for the purpose of achieving electric current stabilization, the electron supplying layer 2 may be formed by a construction in which a metallic film and a resistance film are layered on the electrically insulative rear substrate 1.

The porous polysilicon layer functioning as the electron transporting layer 3 was formed by an LPCVD (Low Pressure Chemical Vapor Deposition) technique using a silane gas as a source gas, and thereafter by an anodic oxidation technique using a water solution of hydrogen fluoride. The porous polysilicon layer of the present example thus formed has a thickness of about 2 $\mu$m. In the present example, the aforethe techniques were employed to form a porous polysilicon layer. Other than this techniques, plasma CVD, optical CVD et cetera may be used to form a porous polysilicon layer.

The gold electrode functioning as the control electrode layer 4 is approximately about 10 nm in thickness because of the requirement that electrons which have been guided to the emission surface through the electron supplying layer 2 and through the electron transporting layer 3 must be emitted therefrom by a tunnel effect. In the present example, such a thin gold film was formed by means of a resistive heating vapor deposition technique.

After that, the porous-substance layer 5 was formed on a surface of the rear substrate 1 provided with the emitter section 12. In the present example, a porous silica layer having a thickness of about 100 $\mu$m was formed by a sol-gel technique.

More specifically, as a silica material-containing solution, a gel material liquid, obtained by preparation of tetramethoxysilane, ethanol, an ammonia water solution (0.1 N) at a mole ratio of 1:3:4 and by a stir treatment to an adequate viscosity, was applied (printed) onto the rear substrate 1 to a thickness of 100 $\mu$m. Thereafter, the coating film became a gel by a sol polymerization reaction, and, as shown in FIG. 2, a silica wet gel structure composed of a three-dimensional network of an Si—O—Si bond was formed. In the present example, a porous silica layer having a thickness of about 100 $\mu$m was formed. However, an optimal value for layer thickness varies depending on the anode voltage value. Although depending also upon the anode voltage value, the layer thickness is preferably approximately not less than 1 $\mu$m and not more than 500 $\mu$m.

Next, the rear substrate 1 provided with the silica wet gel was cleaned by the use of ethanol (solvent replacement). Thereafter, supercritical drying was carried out by the use of carbon dioxide to obtain a porous silica layer composed of a dry gel. The supercritical drying was carried out at a pressure of 12 MPa and at a temperature of 50 degrees Centigrade and, after an elapse of four hours, the pressure was gradually released down to the atmospheric pressure level and, thereafter, the temperature was decreased. The porosity of the resulting porous silica layer comprised of the obtained dry gel was about 92%. The average hole diameter was estimated by the BET (Brunauer, Emmett and Teller) method and the result was about 20 nm. The dried rear substrate 1 was finally subjected to an annealing treatment at 400 degrees Centigrade in an atmosphere of nitrogen for removal of substances adsorbed to the porous-substance layer 5.

Subsequently, a transparent conductive film (ITO) functioning as the anode electrode 7 was layered onto a principal surface of the front substrate 8 composed of a glass plate, and ZnO:Zn as the fluorescent-substance layer 6 was applied on the transparent conductive film. Hereby, the anode section 13 was formed.

Next, in a vacuum chamber, the rear substrate 1 on which the emitter section 12 and the porous-substance layer 5 were formed and the front substrate 8 on which the anode section 13 was formed were bonded together so that the porous-substance layer 5 and the anode section 13 come into abutment with each other, whereby the fluorescent-substance light emitting element 11 as shown in FIG. 1 was produced.

Next, the characteristics of the fluorescent-substance light emitting element 11 thus produced were measured in a vacuum chamber. Stated another way, a voltage (which is positive on the control electrode side) was applied between the electron supplying layer 2 and control electrode layer 4 of the fluorescent-substance light emitting element 11 for causing emission of electrons from the emitter section 12 to the porous-substance layer 5, while a voltage of 300 V was applied between the control electrode layer 4 and the anode electrode 7, and emitted electric currents and fluorescent-substance light-emission luminance were measured. As a result, a value of several tens of mA/cm$^2$ was observed as an emitted electric current density and a light-emission luminance of 200 to 300 cd/m$^2$ was obtained.

Second Example

The second example differs from the first example in that the method of forming the porous-substance layer 5 in the production method of the fluorescent-substance light emitting element 11 is altered. The results obtained are shown below.

In the step of forming the porous-substance layer 5, the electrodialysis of silicate of soda was carried out to prepare a water solution of silicate of pH 9 to pH 10 (silica component concentration in the water solution: 14% by weight). After the pH of the silicate water solution was adjusted to a value of pH 5.5, this gel source material liquid was applied (printed) onto the surface of the rear substrate 1 to a thickness of 100 μm. Thereafter, the coating film became a gel, and a solidified silica wet gel layer was formed.

The rear substrate 1 coated with the silica wet gel layer was subjected to a hydrophobic treatment by immersion in a 5 wt % isopropyl alcohol solution of dimethylmethoxysilane. Thereafter, drying under reduced pressure was carried out, as a result of which a porous silica layer composed of a dry gel was obtained. Such drying was carried out for three hours at a pressure of 0.05 MPa and at a temperature of 50 degrees Centigrade, after which the temperature was reduced when the pressure became equal to the atmospheric pressure level. The dried rear substrate 1 was finally subjected to an annealing treatment at 400 degrees Centigrade in an atmosphere of nitrogen for removal of substances adsorbed to the porous-substance layer 5. As a result, the porous-substance layer 5 composed of a porous silica layer almost similar to that of the first example was obtained.

Next, the characteristics of the fluorescent-substance light emitting element 11 thus produced was measured in a vacuum chamber. Stated another way, a voltage (which is positive on the control electrode side) was applied between the electron supplying layer 2 and control electrode layer 4 of the fluorescent-substance light emitting element 11 for causing emission of electrons from the emitter section 12 to the porous-substance layer 5, while a voltage of 300 V was applied between the control electrode layer 4 and the anode electrode 7, and emitted electric currents and fluorescent-substance light-emission luminance were measured. As a result, a similar emitted electric current and light-emission luminance to the first example were obtained.

Third Example

In the third example, the fluorescent-substance light emitting element 11 was produced in the same way as the first example, in this example the structure of a porous silica layer which serves as the porous-substance layer 5 was changed to study the dependency of the characteristics of the fluorescent-substance light emitting element 11 upon the porous silica layer structure. The results shows that the light-emission luminance of the fluorescent substance significantly falls off because, when the volume ratio of the solid skeletal part 17 to the entire porous silica layer (hereinafter referred to just as "the volume ratio of the solid skeletal part 17") increases to above 15%, the average energy of accelerated emitted electrons is reduced due to scattering. Likewise, also when the size of particles constituting the porous silica layer increases to above 20 nm, the drop in light-emission luminance was observed for the same reason.

From the above, a preferable structure of the porous silica layer which provides a sufficiently strong three-dimensional network and has the function of allowing emitted electrons to pass therethrough is suggested as follows.

The volume ratio of the solid skeletal part 17 (the volume ratio of which is defined as a value found by dividing the volume that the solid skeletal part 17 occupies in the porous-substance 20 by the volume that the porous substance 20 occupies (i.e., the sum of the volume that the solid skeletal part 17 occupies and the volume that the continuous holes 18 occupy)) is preferably greater than 0% but not more than 15%, more preferably not less than 3% and not more than 15%. If the volume ratio of the solid skeletal part 17 falls below 3%, there is the possibility that the shape retaining function of the solid skeletal part 17 becomes poor. On the other hand, if the volume ratio of the solid skeletal part 17 exceeds 15%, this will increase the energy loss of emitted electrons.

Additionally, the size of particles constituting the solid skeletal part 17 is preferably not less than 3 nm and not more than 20 nm, more preferably not less than 3 nm and not more than 10 nm. If the particle size falls below 3 nm, there is the possibility that the particle network is not well connected. On the other hand, if the particle size exceeds 20 nm, this will increase the energy loss of emitted electrons.

With respect to the present example, the suitable degree of vacuum of the porous-substance layer 5 (the air pressure of a region between the emitter section 12 and the anode section 13 (gas pressure)) was studied. Results of the study show the following.

It is preferable that the air pressure of the porous-substance layer 5 is not less than $1.33\times10^{-3}$ Pa and not more than $1.01\times10^{5}$ Pa (atmospheric pressure), more preferably not less than $1.33\times10^{-2}$ Pa and not more than $1.33\times10^{-1}$ Pa.

The reason for the above is as follows. Although the energy loss of emitted electrons generally decreases as the air pressure decreases (in other words, the degree of vacuum is high), the probability of existence of gas molecules in a hole portion serving as a path along which electrons travel is low in the fluorescent-substance light emitting element 11 of the present invention because the electron accelerating region has a porous structure. As a result, electron scattering is unlikely to take place. Accordingly, when taking into consideration the performance of vacuum pumps and housings for maintaining the porous-substance layer 5 in a vacuum ambient, the aforethe ranges are suitable. For example, if, like the prior art techniques, the air pressure is $1.33\times10^{-4}$ Pa, this requires not only a high-performance vacuum pump but also a housing of high airtightness. On the other hand, if the air pressure is $1.33\times10^{-3}$ Pa, this provides advantages. One advantage is that a vacuum pump of normal performance suffices. Another advantage is that the housing (for example, the housing 101 of FIG. 1) is not required to have such high airtightness.

Second Embodiment

Figure 3:
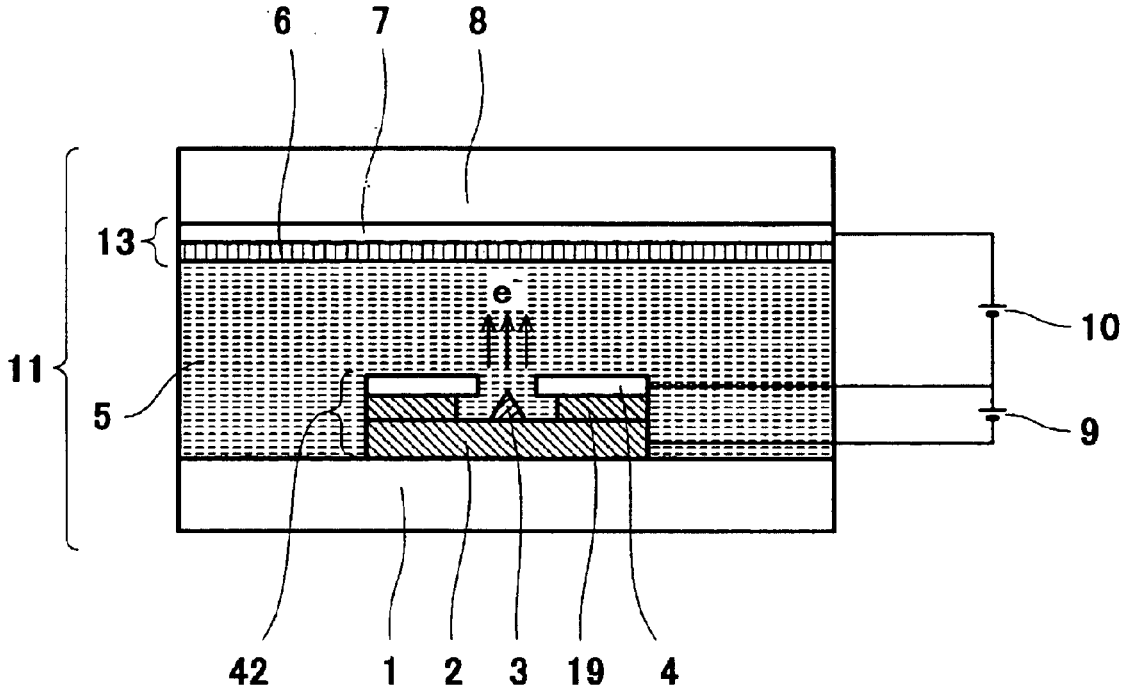
FIG. 3 is a cross sectional view typically showing a configuration of a fluorescent-substance light emitting element according to a second embodiment of the present invention.

FIG. 3 is a cross-sectional view typically showing a configuration of a fluorescent-substance light emitting element according to a second embodiment of the present invention. In FIG. 3, the same reference numerals as FIG. 1 represent like or equivalent parts.

As shown in FIG. 3, the fluorescent-substance light emitting element 11 of the present embodiment has a Spindt-type emitter section 42. The emitter section 42 is provided with a lower electrode 2, a conical structural part 19 of Si or Mo, and a gate electrode 4 which are equivalent to the electron supplying layer 2, the electron transporting layer 3, and the control electrode layer 4 of the fluorescent-substance light emitting element 11 of the first embodiment, respectively. The lower electrode 2 and the gate electrode 4 are electrically isolated from each other by an insulator layer 19.

An acceleration voltage is applied between the gate electrode 4 and the anode electrode 7, and a control voltage is applied between the lower electrode 2 and the gate electrode 4.

Other configurations of the second embodiment are the same as the first embodiment.

Third Embodiment

Figure 4:
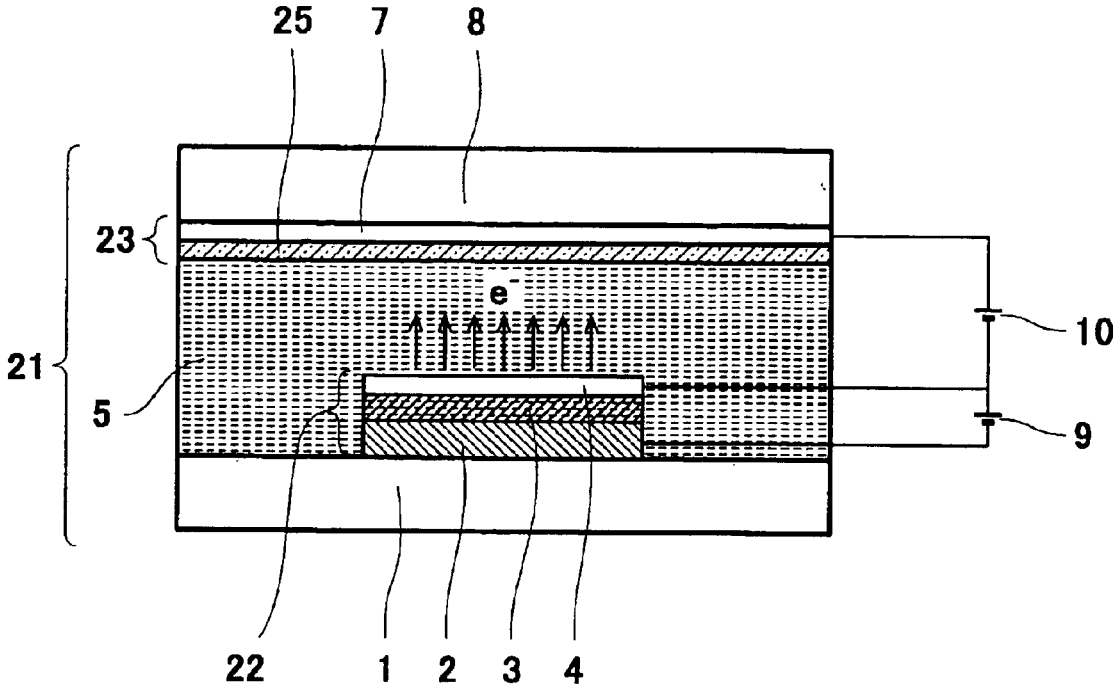
FIG. 4 is a cross sectional view typically showing a configuration of a fluorescent-substance light emitting element according to a third embodiment of the present invention.

FIG. 4 is a cross-sectional view typically showing a configuration of a fluorescent-substance light emitting element according to a third embodiment of the present invention. In FIG. 4, the same reference numerals as FIG. 1 represent like or equivalent parts.

As shown in FIG. 4, the fluorescent-substance light emitting element 21 of the present embodiment is provided with a porous fluorescent-substance layer 25 in place of the fluorescent-substance layer 6 of the fluorescent-substance light emitting element 11 of the first embodiment. The porous fluorescent-substance layer 25 and the anode electrode 7 together constitute an anode section 23. An emitter section 22 of the present embodiment is constructed in the same way as the emitter section 12 of the first embodiment. Other configurations of the third embodiment are the same as the first embodiment.

Next, a method of fabricating the fluorescent-substance light emitting element 21 including a step of forming the porous fluorescent-substance layer 25 and its characteristics will be described below.

In the first place, semiconductor microparticles of nano-size (for example, ZnSe- based, ZnS- based, and CdTe-based semiconductor microparticles) used as a fluorescent substance were prepared by means of a water solution technique or a technique called as a coprecipitation method. Furthermore, the semiconductor microparticles thus prepared were dispersed in a solvent and, thereafter, were mixed with a silica porous gel source material liquid. This mixed liquid is hereinafter called the "second gel source material liquid".

Meanwhile, a silica porous gel source material liquid not mixed with semiconductor microparticles (hereinafter called the "first gel source material liquid"), was prepared. Then, the first gel source material liquid and the second gel source material liquid were applied (printed), in this order, onto the surface of the rear substrate 1 provided with the emitter section 22 to respective predetermined thickness values. Thereafter, like the first embodiment, a dry gel structure was formed by means of a sol-gel reaction. Hereby, the porous fluorescent-substance layer 25, composed of a nano-composite structural body in which semiconductor microparticles were scattered in hole portions of the porous substance of silica, was formed on the porous-substance layer 5 described in the first embodiment. The first gel source material liquid and the second gel source material liquid were applied onto the rear substrate 1 by means of spin coating. The thickness of the porous fluorescent-substance layer 25 thus formed is about 5 $\mu$m.

Next, in a vacuum chamber, the rear substrate 1 thus prepared and the front substrate 8 prepared in the same way as the first embodiment were bonded together with the porous fluorescent-substance layer 25 in abutment with the anode electrode 7. Hereby, the fluorescent-substance light emitting element 21 of the present embodiment was obtained.

Next, the characteristics of the fluorescent-substance light emitting element 21 thus prepared was measured in a vacuum chamber. Stated another way, a voltage (which is positive on the control electrode side) was applied between the electron supplying layer 2 and control electrode layer 4 of the fluorescent-substance light emitting element 21 for causing emission of electrons from the emitter section 22 to the porous-substance layer 5, while a voltage of 300 V was applied between the control electrode layer 4 and the anode electrode 7, and emitted electric currents and fluorescent-substance light-emission luminance were measured. The employment of the fluorescent-substance layer 25 composed of a nano-size porous structure achieves an increase in effective area of the fluorescent-substance, thereby providing improvements in light-emission efficiency. As a result, a light-emission luminance of 400 to 500 cd/m$^2$ was obtained

Fourth Embodiment

Figure 5:
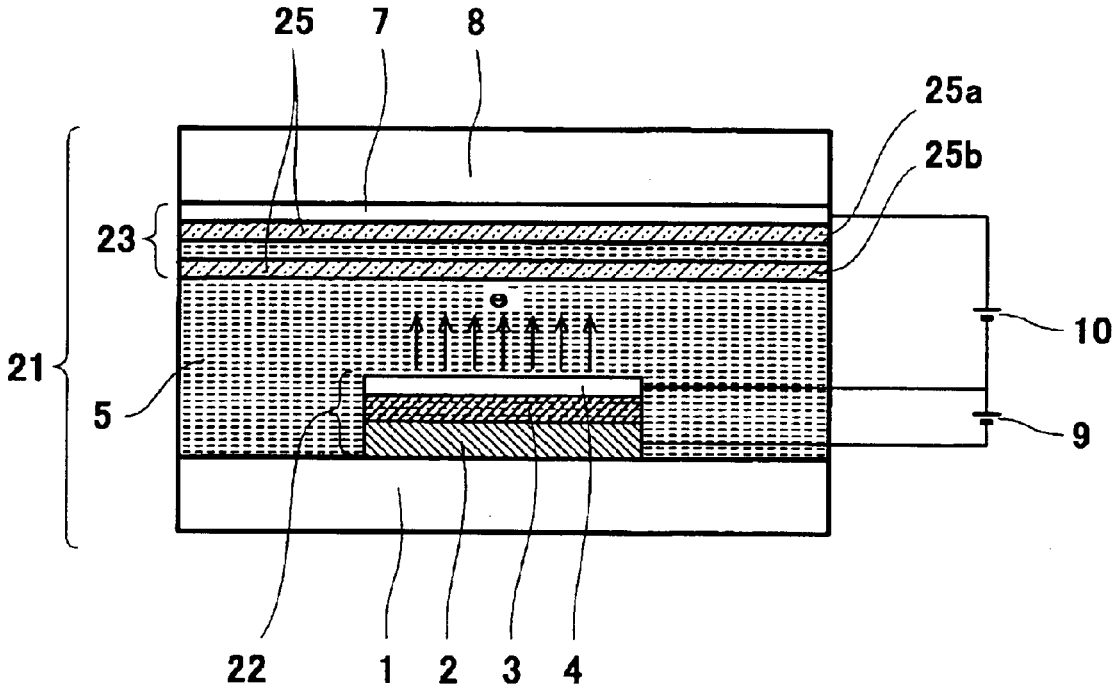
FIG. 5 is a cross sectional view typically showing a configuration of a fluorescent-substance light emitting element according to a fourth embodiment of the present invention.

FIG. 5 is a cross-sectional view typically showing a configuration of a fluorescent-substance light emitting element according to a fourth embodiment of the present invention. In FIG. 5, the same reference numerals as FIG. 4 represent like or equivalent parts.

As shown in FIG. 5, in the fluorescent-substance light emitting element 21 of the present embodiment, a second porous fluorescent-substance layer **25*b* is provided also in the inside of the porous-substance layer 5. Other configurations of the present embodiment are the same as the third embodiment. It should be noted that the porous fluorescent-substance layer 25 of the present embodiment which is identical with the porous fluorescent-substance layer 25 of the third embodiment is a first porous fluorescent-substance layer represented by reference numeral 25*a*** for the sake of distinction.

Since the way of forming the porous fluorescent-substance layer 25 in the inside of the porous-substance layer 5 is based on the third embodiment, its description is omitted here. Unlike the prior art techniques in which the region of accelerating emitted electrons is constituted by a space, the emitted-electron acceleration region of the present embodiment is constituted by the solid structural part 5 made of a porous substance. This configuration makes it possible to dispose a fluorescent-substance layer also in the emitted-electron acceleration region. As a result, there is achieved an increase in effective area of the fluorescent-substance region, so that the light-emission luminance of the fluorescent substance is improved to a further extent.

Fifth Embodiment

Figure 6:
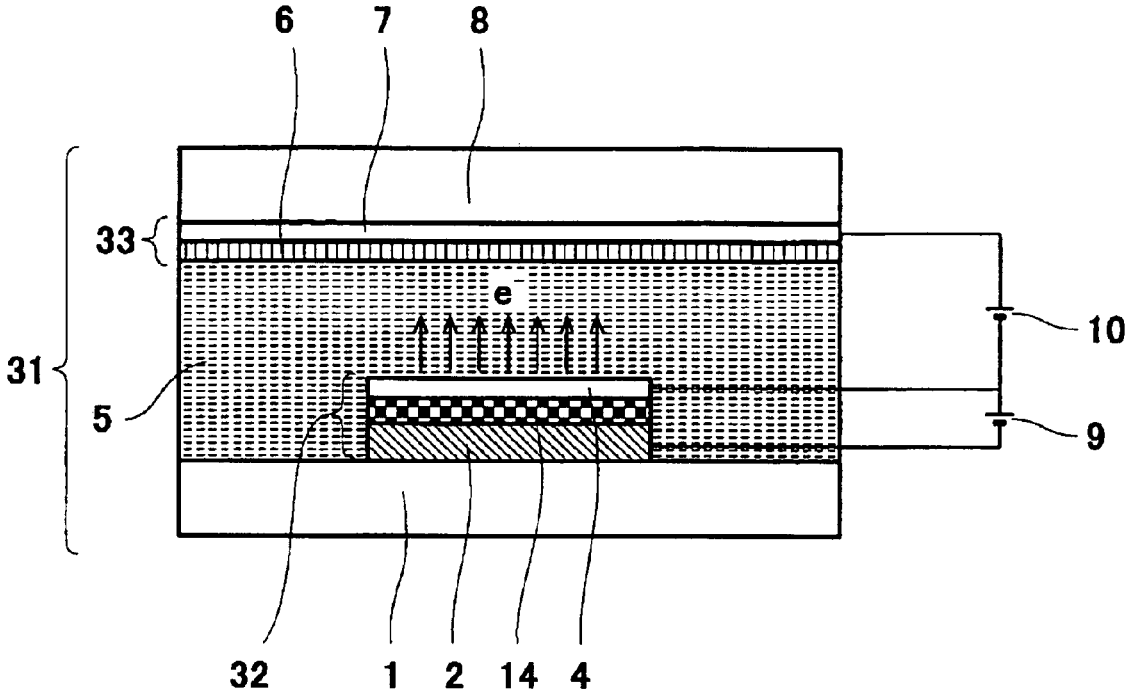
FIG. 6 is a cross sectional view typically showing a configuration of a fluorescent-substance light emitting element according to a fifth embodiment of the present invention.

FIG. 6 is a cross-sectional view typically showing a configuration of a fluorescent-substance light emitting element according to a fifth embodiment of the present invention. In FIG. 6, the same reference numerals as FIG. 1 represent like or equivalent parts.

As shown in FIG. 6, in the fluorescent-substance light emitting element 31 of the present embodiment, a surface of an electron transporting layer 14 of an emitter section 32 on the side of the control electrode layer 4 has either a negative electron affinity or an electron affinity close to zero. The rear substrate 1, on which the emitter section 32 is formed, is composed of a sapphire substrate. An anode section 33 is constructed in the same way as the anode section 13 of the first embodiment. Other configurations of the fifth embodiment are the same as the first embodiment.

More specifically, the electron supplying layer 2 is composed of n-GaN. The electron transporting layer 14, through which electrons smoothly move from the electron supplying layer 2 to the control electrode layer 4, is composed of a non-doped $Al_xGa_{1-x}N$ (where x is a variable which almost continuously increases from zero to one) having gradient composition in which the Al content ratio x continuously varies in the direction of the thickness. The control electrode layer 4 is composed of metal such as platinum (Pt). As a result of such configuration, the surface of the electron transporting layer 14 made of $Al_xGa_{1-x}N$ is placed in a state in which a negative electron affinity acts, in other words the surface of the electron transporting layer 14 is in a state extremely ready to emit electrons.

Next, a method of fabricating the fluorescent-substance light emitting element 31 of the present embodiment will be described.

Here, a method of forming the emitter section 31 which characterizes the present embodiment is described. Other parts are produced in the same way as the first embodiment.

In the first place, a GaN buffer layer (not shown) is formed on the sapphire substrate 1 by reaction of trimethyl gallium (TMG) and ammonia ($NH_3$) by an MOCVD (Metal Organic CVD) technique. Thereafter, the n-GaN layer 2, which is an electron supplying layer, is formed by addition of silane ($SiH_4$) to a reaction gas of the same kind.

Next, the supply of $SiH_4$ which is a dope gas is stopped. Thereafter, trimethyl aluminum (TMA) is introduced and the dopant amount of Al is increased gradually to start forming the $Al_xGa_{1-x}N$ layer 14, and in mid course of the formation the supply of TMG is reduced gradually to continuously form the $Al_xGa_{1-x}N$ layer 14 of a high Al content ratio.

Finally, the Al content ratio x was brought to 1 (that is, by bringing the Ga content ratio to zero), thereby the surface on the side of the control electrode 4 became an AlN layer. At this time, the reaction temperature may be increased gradually for growth of the $Al_xGa_{1-x}N$ layer 14 of high quality. By such a technique, it becomes possible to continuously form the n-GaN layer 2 which is an electron supplying layer and the $Al_xGa_{1-x}N$ layer 14 which is an electron transporting layer at high quality levels. In the present embodiment, the thickness of the n-GaN layer 2 is 4 $\mu$m. The thickness of the $Al_xGa_{1-x}N$ layer 14 is 0.07 $\mu$m. The formation method of the n-GaN layer 2, the $Al_xGa_{1-x}N$ layer, and the AlN layer is not limited to the foregoing method. For example, instead of employing an MOCVD technique, an MBE (Molecular Beam Epitaxy) technique or the like may be used as a formation technique.

Furthermore, the control electrode layer 4 is formed on the surface of the electron transporting layer 14. The material of the control electrode layer 4 should be selected appropriately. It is preferable that the control electrode layer 4 is made of Pt, Au, Ni, Ti et cetera. Additionally, the formation method of the control electrode layer 4 is not limited to a particular one. The control electrode layer 4 is formed generally by means of an electron beam vapor deposit technique. In the present embodiment, the thickness of the control electrode layer 4 is from 5 nm to 10 nm.

Next, in a vacuum chamber, the rear substrate 1 provided with the emitter section 32 and the porous-substance layer 5, and the front substrate 8 provided with the anode section 33 are bonded together with the porous fluorescent-substance layer 5 in abutment with the anode section 33, whereby the fluorescent-substance light emitting element 31 as shown in FIG. 6 is fabricated.

Next, the characteristics of the fluorescent-substance light emitting element 31 thus fabricated was measured in a vacuum chamber. Stated another way, a voltage (which is positive on the control electrode side) was applied between the electron supplying layer 2 and control electrode layer 4 of the fluorescent-substance light emitting element 31 for causing emission of electrons from the emitter section 32 to the porous-substance layer 5, while a voltage of 300 V was applied between the control electrode layer 4 and the anode electrode 7, and emitted electric currents and fluorescent-substance light-emission luminance were measured. As a result, a value of several hundreds of $mA/cm^2$ as an emitted electric current density was observed, and a light-emission luminance of about 500 $cd/m^2$ was obtained.

Sixth Embodiment

In each of the first to fifth embodiments, the single fluorescent-substance light emitting element is illustrated by an example. However, the configuration in which a plurality of such fluorescent-substance light emitting elements are arrayed two-dimensionally and the amount of light emission of each fluorescent-substance light emitting element is controlled makes it possible for fluorescent-substance light emitting elements to be applied to devices for displaying images and characters.

Figure 7:
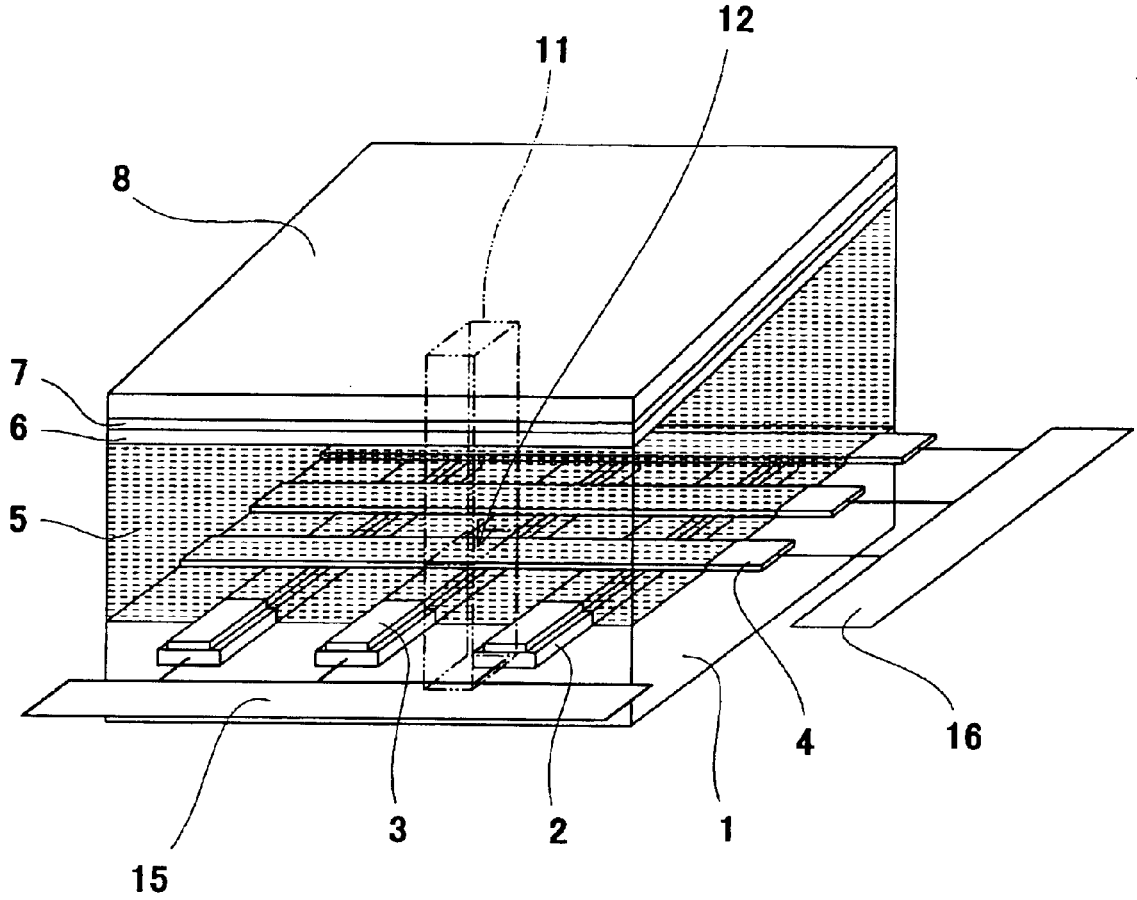
FIG. 7 is a perspective view typically showing in cross section a configuration of an image rendering device according to a sixth embodiment of the present invention.

FIG. 7 is a cross sectional perspective view typically showing a configuration of an image rendering device according to a sixth embodiment of the present invention. In FIG. 7, the same reference numerals as FIG. 1 represent like or equivalent parts.

As can be seen from FIG. 7, in the image rendering device of the present embodiment, a plurality of strip-like lower electrodes 2 (the number of which is three in the present embodiment) are formed on the rear substrate 1 at predetermined intervals and in parallel to each other. Each lower electrode 2 functions as an electron supplying layer. Formed on each lower electrode 2 is a strip-like porous polysilicon layer 3. Each porous polysilicon layer 3 functions as an electron transporting layer. A plurality of strip-like upper electrodes 4 (the number of which is three in the present embodiment) are formed on the porous polysilicon layers 3 at predetermined intervals, in parallel to each other and in orthogonal to the lower electrodes 2. Each upper electrode 4 functions as a control electrode. The porous-substance layer 5 is formed on the rear substrate 1 thus provided with the lower electrodes 2, the porous polysilicon layers 3, and the upper electrodes 4.

On the other hand, the anode electrode 7 and the fluorescent-substance layer 6 are formed on an inner surface (lower surface) of the front substrate 8. The front substrate 8 is disposed to be opposed to the rear substrate 1 so that the fluorescent-substance layer 6 is in abutment relationship to the porous-substance layer 5 of the rear substrate 1.

The lower and upper electrodes 2 and 4 are connected to drivers 15 and 16 for driving emitter section (which correspond to the control power supply 9), respectively. Additionally, an acceleration power supply (see FIG. 1 (not shown in FIG. 7)) is connected between the upper and anode electrodes.

The image rendering device of the present embodiment employs an image display method which is called "a normal (simple) matrix drive". In the normal matrix drive technique, a portion 11 where the lower electrode 2 and the upper electrode 4 intersect with each other in plan view constitutes a pixel. Accordingly, the image rendering device has a screen made up of 3 (lines)×3 (rows)=9 pixels. On the other hand, a portion corresponding to a pixel in the image rendering device constitutes the fluorescent-substance light emitting element 11 of FIG. 1 (the first embodiment), and a portion 12 where the lower electrode 2 and the upper electrode 4 overlap with each other constitutes an emitter section of the fluorescent-substance light emitting element 11. Accordingly, in the image rendering device, a plurality of fluorescent-substance light emitting elements of FIG. 1 (the number of which is nine here) are arrayed two-dimensionally.

In the image rendering device thus constructed, when image data is input to the paired drivers 15 and 16 in conjunction with a synchronization signal, according to the input image data, a specific quantity of electron is emitted from an electron emission surface of the emitter section 12 of the fluorescent-substance light emitting element 11 of a specific pixel to the porous-substance layer 5. The emitted electrons are accelerated in the inside of the porous-substance layer 5 by an anode voltage applied to the anode electrode 7, and collide with the fluorescent-substance layer 6. Hereby, the fluorescent-substance layer 6 emits light. Accordingly, the fluorescent-substance layer 6 emits light according to the image data. Therefore, by inputting, as image data, an image of any shape and any luminance to the image rendering device, the image is rendered.

Numerous modifications and alternative embodiments of the present invention will be apparent to those skilled in the art in view of the foregoing description. Accordingly, the description is to be construed as illustrative only, and is provided for the purpose of teaching those skilled in the art the best mode of carrying out the present invention. The details of the structure and/or function may be varied substantially without departing from the sprit of the present invention and all modifications which come within the scope of the appended claims are reserved.

What is claimed is:

1. A fluorescent-substance light emitting element comprising:

a cold cathode type emitter section for emitting electrons, a fluorescent-substance layer configured to emit light by collision with electrons emitted from the emitter section, and an anode section disposed to be opposed to the emitter section and having an anode electrode and the fluorescent-substance layer provided inside of the anode electrode, wherein a porous-substance layer, composed of an electrically insulative porous substance, is sandwiched between the emitter section and the anode section, the electrons emitted from the emitter section pass through the porous-substance layer and the fluorescent-substance layer is irradiated with the electrons that have passed through the porous-substance layer, and the porous substance has a solid skeletal part formed into a three-dimensional network shape and a hole extending continuously in the form of a mesh of the solid skeletal part.

2. The fluorescent-substance light emitting element according to claim 1, wherein the porous-substance layer is in contact with the emitter section.

3. The fluorescent-substance light emitting element according to claim 1, wherein the porous-substance layer is in contact with the anode section.

4. The fluorescent-substance light emitting element according to claim 1, wherein the porous-substance layer is in contact with both the emitter section and the anode section.

5. The fluorescent-substance light emitting element according to claim 1, wherein the volume ratio of the solid skeletal part in the porous-substance layer is more than 0% and not more than 15%.

6. The fluorescent-substance light emitting element according to claim 5, wherein the volume ratio of the solid skeletal part in the porous-substance layer is not less than 3% and not more than 15%.

7. The fluorescent-substance light emitting element according to claim 1, wherein the solid skeletal part of the porous-substance layer is composed of a plurality of particles connected together and a size of the particles is not less than 3 nm and not more than 20 nm.

8. The fluorescent-substance light emitting element according to claim 7, wherein the size of the particle is not less than 3 nm and not more than 10 nm.

9. The fluorescent-substance light emitting element according to claim 1, wherein gas pressure of a region between the emitter section and the anode section is not less than $1.33\times10^{-3}$ Pa and not more than $1.01\times10^{5}$ Pa.

10. The fluorescent-substance light emitting element according to claim 9, wherein the gas pressure of the region between the emitter section and the anode section is not less than $1.33\times10^{-2}$ Pa and not more than $1.33\times10^{-1}$ Pa.

11. The fluorescent-substance light emitting element according to claim 1, wherein the fluorescent-substance layer is formed by a porous fluorescent-substance layer in which a fluorescent substance is scattered in the hole portion of a porous substance.

12. The fluorescent-substance light emitting element according to claim 11, wherein:

the porous fluorescent-substance layer comprises a first porous fluorescent-substance layer and a second porous fluorescent-substance layer, the first porous fluorescent-substance layer is formed in contact with the anode electrode, and the second porous fluorescent-substance layer is formed in the porous-substance layer.

13. The fluorescent-substance light emitting element according to claim 1, wherein the emitter section has an electron supplying layer for supplying electrons, an electron transporting layer in which electrons supplied from the electron supplying layer are movable, and a control electrode layer for emission of electrons moving in the electron transporting layer from the emitter section by a voltage applied between the control electrode layer and the electron supplying layer.

14. The fluorescent-substance light emitting element according to claim 13, wherein a surface of the electron transporting layer close to the control electrode layer has either a negative electron affinity or an electron affinity close to zero.

15. The fluorescent-substance light emitting element according to claim 1, wherein the emitter section is formed by a cold cathode type emitter of one of MIM, BSD, and Spindt type.

16. A method for fabricating a fluorescent-substance light emitting element having a cold cathode type emitter section for emitting electrons, a fluorescent-substance layer configured to emit light by collision with electrons emitted from the emitter section, and an anode section disposed to be opposed to the emitter section and having an anode electrode and the fluorescent-substance layer provided inside of the anode electrode, wherein the electrons emitted from the emitter section pass through a porous-substance layer and the fluorescent-substance layer is irradiated with the electrons that have gassed through the porous-substance layer, and a porous substance has a solid skeletal part formed into a three-dimensional network shape and a hole extending continuously in the form of a mesh of the solid skeletal part, the method comprising the step of providing, between the emitter section and the anode section, the porous-substance layer comprising the porous substance which is the solid substance having the solid skeletal part formed into the three-dimensional network shape and the hole extending continuously in the form of a mesh of the solid skeletal part, the porous substance being electrically insulative.

17. The method for fabricating a fluorescent-substance light emitting element according to claim 16, wherein the porous-substance layer is formed by means of a sol-gel transition reaction.

18. The method for fabricating a fluorescent-substance light emitting element according to claim 17, wherein, in formation of the porous-substance layer, a wet gel structure is dried by a supercritical dry technique.

19. An image rendering device comprising a fluorescent-substance light emitting element according to claim 1.

20. The fluorescent-substance light emitting element according to claim 1, wherein the solid skeletal part is entirely composed of silica, alumina, or magnesium oxide.

21. The method for fabricating a fluorescent-substance light emitting element according to claim 16, wherein the solid skeletal part is entirely composed of silica, alumina, or magnesium oxide.

22. The method for fabricating a fluorescent-substance light emitting element according to claim 16, wherein the emitter section is formed by a cold cathode type emitter of one of MIM, BSD, and Spindt type.

* * * * *

UNITED STATES PATENT AND TRADEMARK OFFICE

CERTIFICATE OF CORRECTION

PATENT NO. : 6,897,606 B2
DATED : May 24, 2005
INVENTOR(S) : Masahiro Deguchi

It is certified that error appears in the above-identified patent and that said Letters Patent is hereby corrected as shown below:

Column 19,
Line 52, change “clement” to -- element --.

Column 20,
Line 53, change “gassed” to -- passed --.

Signed and Sealed this

Fifteenth Day of November, 2005

JON W. DUDAS
*Director of the United States Patent and Trademark Office*